US007226127B1

(12) United States Patent
Yevko et al.

(10) Patent No.: US 7,226,127 B1
(45) Date of Patent: Jun. 5, 2007

(54) ERGONOMIC CHAIR BACKREST

(75) Inventors: Vladimir Yevko, Vaughan (CA); Eugene Eliseev, Toronto (CA); Wolfgang Deisig, Berlin (DE)

(73) Assignee: TK Canada Limited, Toronto, Ontario ( * ) Notice: Subject to any disclaimer, the term of this patent is extended or adjusted under 35 U.S.C. 154(b) by 0 days.

(21) Appl. No.: 11/314,798

(22) Filed: Dec. 21, 2005

(51) Int. Cl.
*A47C 3/00* (2006.01)

(52) U.S. Cl. ..... 297/284.1; 297/296; 297/297; 297/285; 297/291; 297/284.4

(58) Field of Classification Search ..... 297/284.1, 297/284.3, 284.4, 296, 297, 298, 285, 440.16, 297/440.21, 291, 289, 299
See application file for complete search history.

(56) References Cited

U.S. PATENT DOCUMENTS 4,313,637 A * 2/1982 Barley ..... 297/284.4
4,880,272 A * 11/1989 Brauning ..... 297/296
5,249,839 A * 10/1993 Faiks et al. ..... 297/300.1
5,505,520 A * 4/1996 Frusti et al. ..... 297/284.4
6,189,971 B1 * 2/2001 Witzig ..... 297/284.11
6,257,665 B1 7/2001 Nagamitsu et al.
6,572,190 B2 * 6/2003 Koepke et al. ..... 297/284.1
6,761,406 B2 * 7/2004 Kinoshita et al. ..... 297/296
7,066,537 B2 * 6/2006 Coffield et al. ..... 297/284.4
7,118,176 B2 * 10/2006 Erker ..... 297/284.1

FOREIGN PATENT DOCUMENTS

DE 20 2004 005 169.9 3/2004

* cited by examiner

*Primary Examiner*—David R. Dunn
*Assistant Examiner*—Erika Garrett
(74) *Attorney, Agent, or Firm*—Michael Best & Friedrich LLP

(57) ABSTRACT

A "task" chair intended primarily for a person working at a computer terminal has a back provided with a pair of upright struts that incorporate respective parallelogram linkages operative to increase the curvature of the lumbar region of the seat back while at least substantially maintaining the contour of the upper region of the backrest when a person leans back in the chair.

7 Claims, 5 Drawing Sheets

ERGONOMIC CHAIR BACKREST

FIELD OF THE INVENTION

This invention relates generally to chairs and is concerned in particular with the chair backs that are designed in accordance with ergonomic principles.

BACKGROUND OF THE INVENTION

The invention has been devised in the context of chair designs that are intended to address problems with respect to the posture and comfort of individuals who are required to spend long periods of time in a seated position, for example, working at a computer. However, the invention is not limited in this respect.

In modern office environments, people who work at computers naturally adjust their seating positions from time to time, for example, by leaning back in their chairs. Some people even work leaning back. Such a sitting posture places significant strain on the upper thorax and neck regions of the person. In other words, if the person leans back, while continuing to keep their eyes on the computer screen, they must inevitably compensate by tilting their head forward, causing strain in the neck and/or upper thorax region.

An object of the present invention is to address this problem by providing an improved chair back structure.

SUMMARY OF THE INVENTION

A chair in accordance with the invention comprises a base, a seat supported on the base and a back coupled to at least one of the seat and base. The back includes a backrest having a normal contour which includes a lower, lumbar region for contact by the lumbar area of a person seated in the chair and which is forwardly curved, and an upper region for contact by the upper thorax of the person. The backrest is biased to the normal contour and is flexible to vary the contour. The back further includes at least one upright strut spanning the lumbar and upper thorax regions of the backrest, the strut having a lower end which is fixed with respect to the seat and an upper end which is coupled to the upper region of the backrest for back and forward movement therewith in response to rearward pressure exerted by said person leaning back against the backrest, and return to said normal contour. The strut includes a parallelogram linkage operative to increase the curvature of the lumbar region while at least substantially maintaining the contour of the upper region of the backrest in response to said rearward pressure.

In other words, as the person leans back, the contour of the backrest changes to support the lumbar area and the upper thorax and/or neck of the person and thereby at least partly alleviate the strain on the upper thorax and neck region that would otherwise occur, for example, when the person leans back while continuing to look at a computer screen as discussed previously.

Preferably, the normal contour of the backrest follows a gentle S-shaped curve in the upright direction of the backrest (top to bottom) including a forwardly curved lumbar region and an upper region in which the top of the backrest curves slightly forwardly so as to tend to augment the support function in the upper thorax and neck region.

While a single strut may be provided, for example, generally centrally of the backrest, a pair of struts preferably is provided, one at each side of the backrest. The strut or struts may be external to the backrest and therefore visible in use, or may be incorporated into the backrest itself or into a supplementary cover at the rear of the backrest.

BRIEF DESCRIPTION OF THE DRAWINGS

In order that the invention may be more clearly understood, reference will now be made to the accompanying drawings which illustrate a particular preferred embodiment of the invention by way of example, and in which.

DETAILED DESCRIPTION OF THE INVENTION

Figure 1:
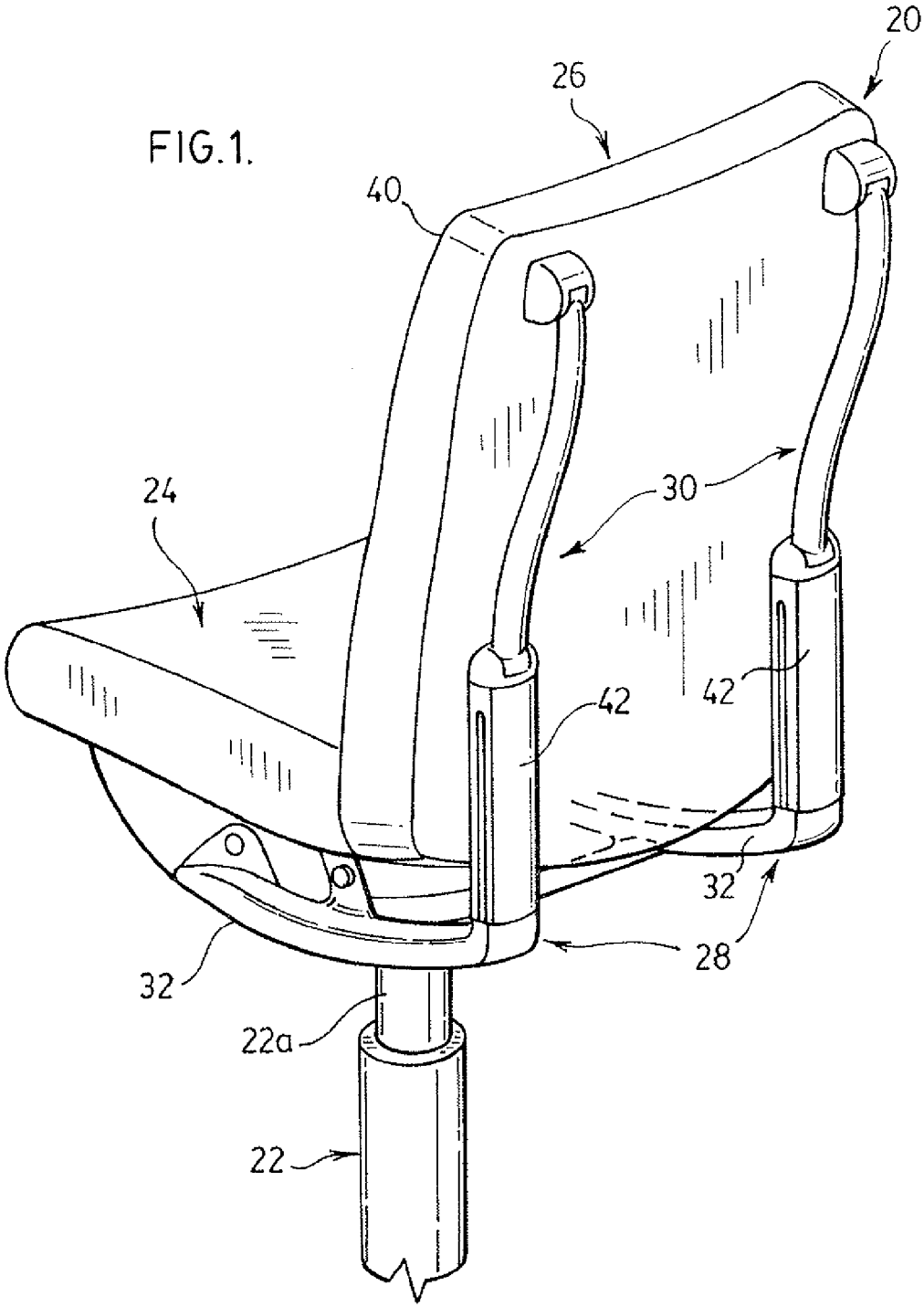
FIG. 1 is a three-quarter perspective view from the rear and to one side of a chair in accordance with the invention.

Referring first to FIG. 1, the invention is illustrated in the context of a typical office or "task" chair generally denoted 20. It is, however, to be understood that the invention may equally well be applied to the backs of other types of chair including so-called sit/stand chairs of the type disclosed in U.S. Pat. No. 6,752,459 (Deisig).

With continued reference to FIG. 1, chair 20 includes a base 22 (only part of which is shown) which supports a seat 24 of the chair. The chair also includes a back 26 that is supported from the seat by a pair of L-shaped arm structures 28. These structures include respective struts 30 which are coupled to the seat back as will be described later, and a pair of forwardly extending arms 32 that are secured to support structure 24*a* of the seat. Though not shown in detail, a conventional tilt mechanism is provided between the base 22 and the seat 24 so that the seat 24 and back 26 can tilt as a unit with respect to the base. The base itself is also conventional and has therefore not been shown in detail. As shown, the base includes a column 22*a* that supports the seat for adjustment in the vertical direction. A conventional "spider"-type base (not shown) is provided at the bottom of column 22.

Figure 2:
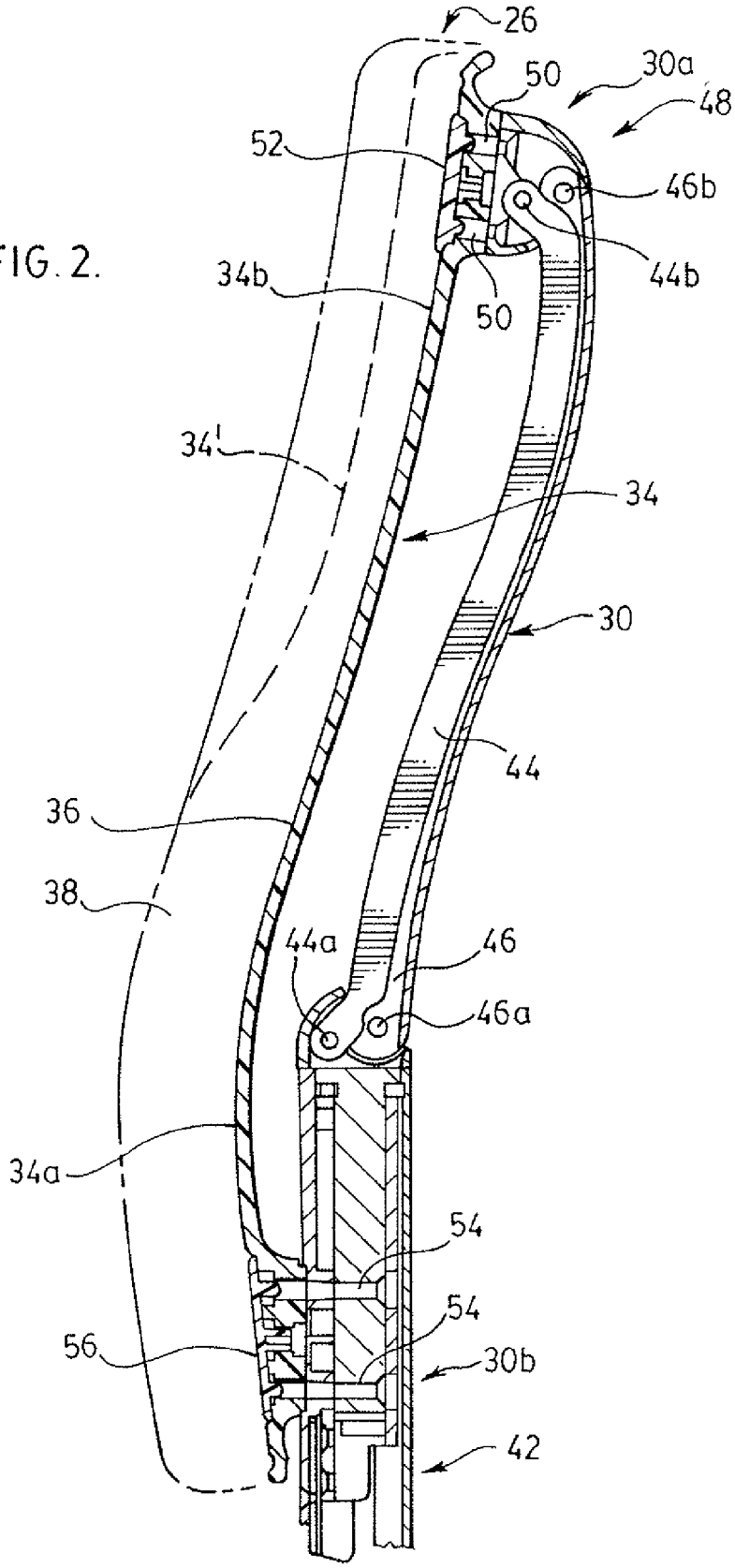
FIG. 2 is a vertical sectional view generally on the centreline of the back of the chair in its normal rest position.
Figure 3:
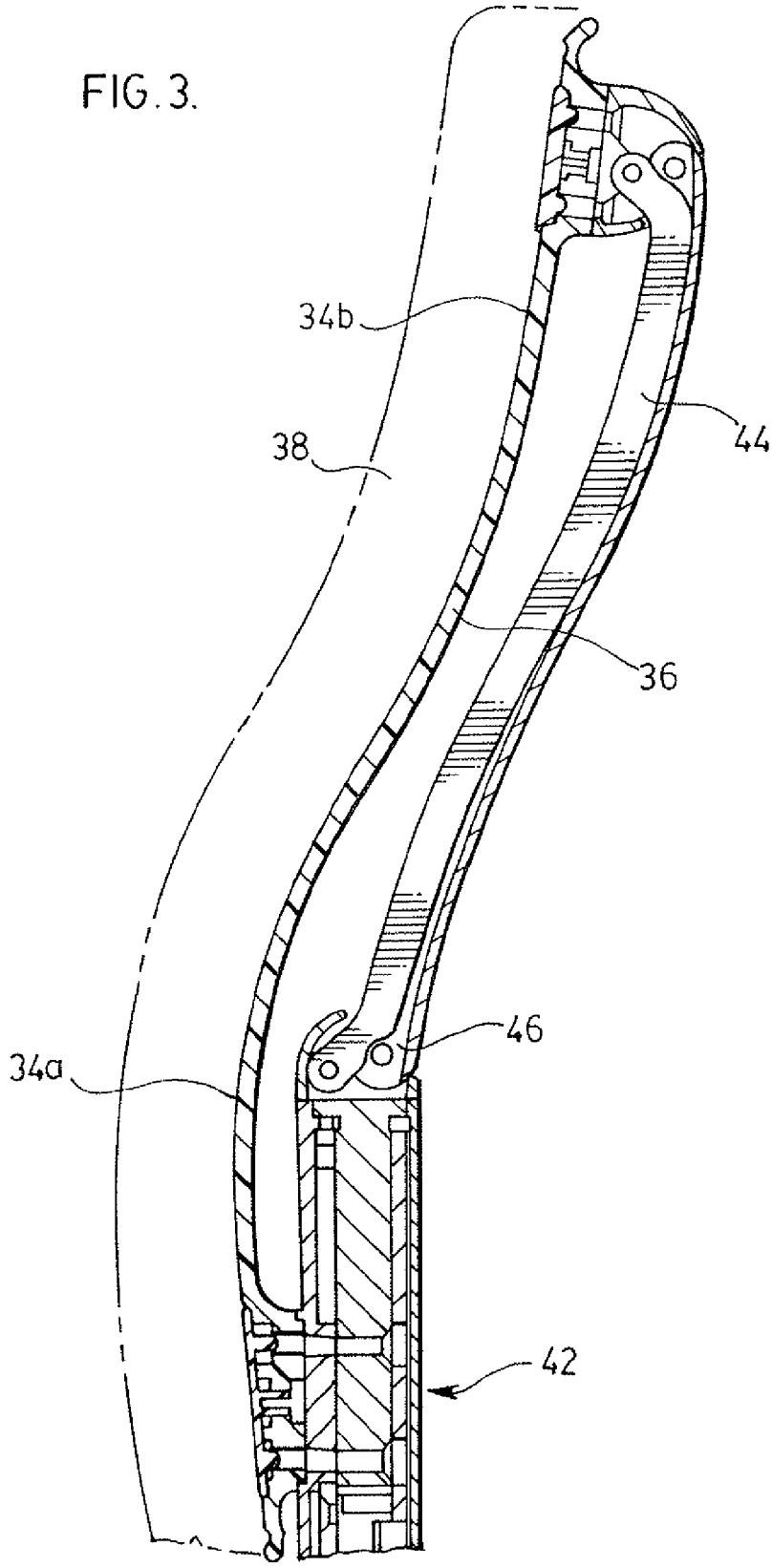
FIG. 3 is a view similar to FIG. 2 showing the contour of the backrest when a person leans back in the chair.

Referring now more particularly to FIGS. 2 and 3, the back 26 includes a backrest 34 for contact by the back of a person sitting on the seat 24. The backrest has a contour which follows a generally S-shaped curve as seen in vertical section. That shape continues outwardly to the sides of the back. The backrest may also be curved laterally to partially wrap around the torso of a person seated on the chair. The backrest includes a lower region 34*a* which is forwardly curved in vertical section for contact by the lumbar area of the person, and an upper region 34*b* for contact by the upper thorax area of the person. The backrest is flexible so that the contour can be varied under the control of the struts 30 (FIG. 1) as will be described in more detail later.

In this particular embodiment, the backrest 34 is a polypropylene moulding, the normal "as moulded" shape of which is seen in FIG. 2. The moulding is flexible as indicated previously and has spring-like characteristics so that it always tends to return to the normal shape shown in FIG. 2. The moulding has a solid back wall 36 which carries a resilient moulded cushion structure 38 for contact with the back of a person using the chair. A cover 40 is provided over the moulding 34 to provide an appropriate aesthetically pleasing external appearance. In the embodiment illustrated in FIG. 4, the struts 30 are shown external and therefore visible at the exterior of the chair. In an alternative embodiment, the struts could be incorporated within the backrest or enclosed within the cover 40.

Reverting to FIG. 2, the two struts 30 of the chair back are identical and a representative one is shown in FIG. 2. Each strut spans substantially the entire height of the back including the lumbar region 34*a* and the thorax region 34*b*. The strut has upper and lower ends 30*a* and 30*b* respectively, which are coupled to the backrest 34. The struts are adapted to vary the contour of the profile of the backrest in response to rearward pressure exerted generally in the thorax region 34*b* by a person leaning back in the chair. The struts confine the backrest to change its contour from the configuration shown in FIG. 2 to the configuration shown in FIG. 3. In FIG. 2, the front face of the backrest is indicated in dotted lines at 34' to show the contour of the backrest in the position of FIG. 3.

As noted previously in referring to FIG. 1, the two struts 30 form part of respective arm structures 28 that connect to the seat. Each arm structure includes a fixed upright portion 42 which extends upwardly behind the backrest 34 of the seat, approximately to the position of the lumbar region 34*a*. The upright portion 42 of one of the struts is shown in detail in FIGS. 2 and 3 and in exploded perspective in FIG. 4. The strut 30 extends upwardly from the upper end of this portion 42. Each strut incorporates a parallelogram linkage comprising first and second links 44, 46 that are pivoted to arm portion 44 at respective pivot points 44*a* and 46*a*. The links extend upwardly behind the backrest to a fitting 48 adjacent the upper margin of the backrest 34, where the links are pivoted to the fitting by corresponding upper pivot axes 44*b* and 46*b* respectively. Fitting 48 is rigidly secured to the backrest 34 by a pair of bolts 50 threaded into a plate 52 at the front face of backrest wall 36. Similarly, the upper portion 42 of the arm structure 28 is bolted to a lower region of the backrest by a pair of bolts 54 that are threaded into a plate 56 at the front face of wall 36.

Figure 5:
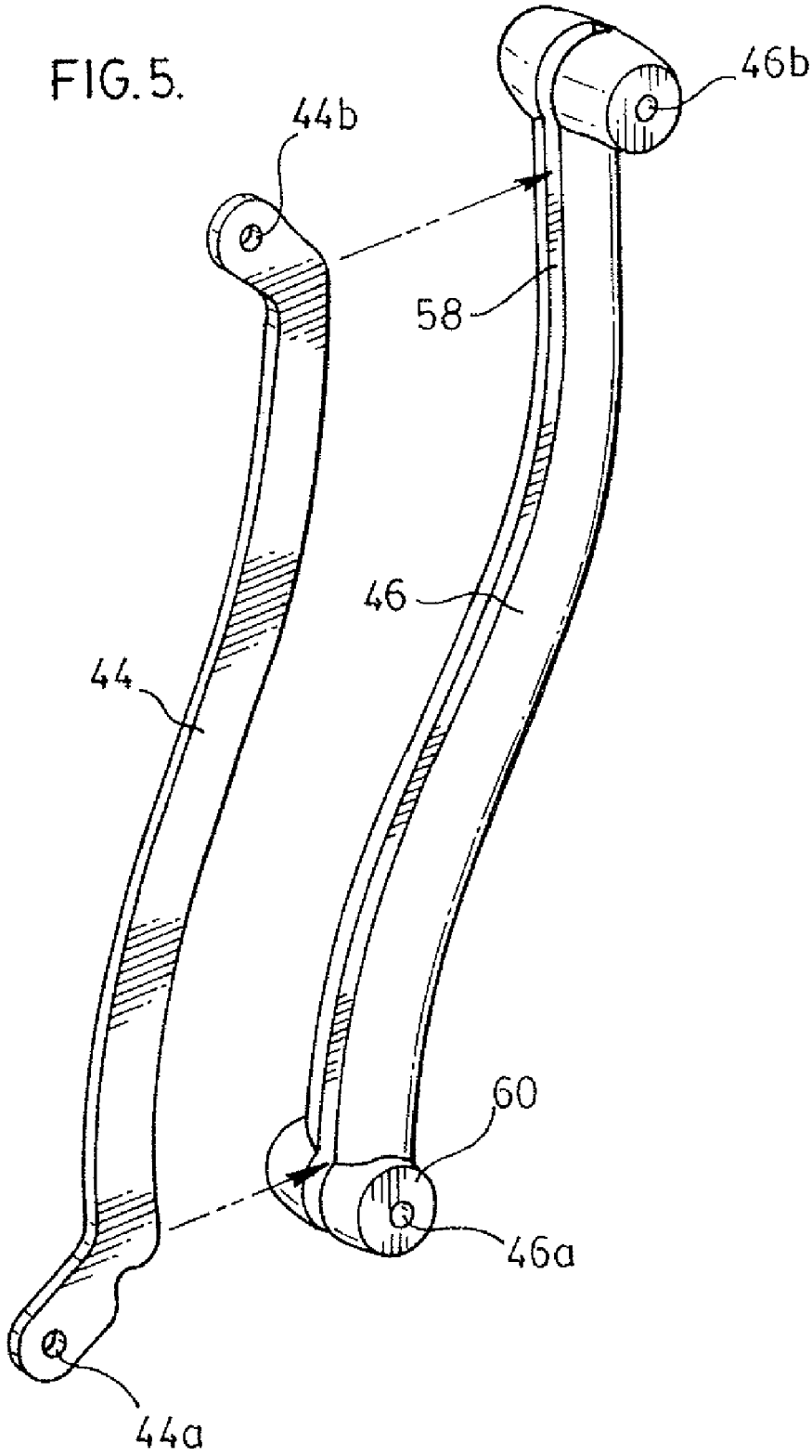

FIG. 5 shows the two links 44 and 46 in isolation. Link 44 is an inner link (closest to the back) and comprises a flat plate with angled portions at respective ends. Link 46 is an outer link and is wider than link 44 and provided with a slot 58 that receives link 44, so that the two links effectively "nest" one within the other. The respective pivot points for link 44 are represented in FIG. 5 by plain holes 44*a* and 44*b* through link 44, while the corresponding pivot points for link 46 are provided by passageways through respective upper and lower bosses 60 and 62 formed as part of link 46.

Figure 4:
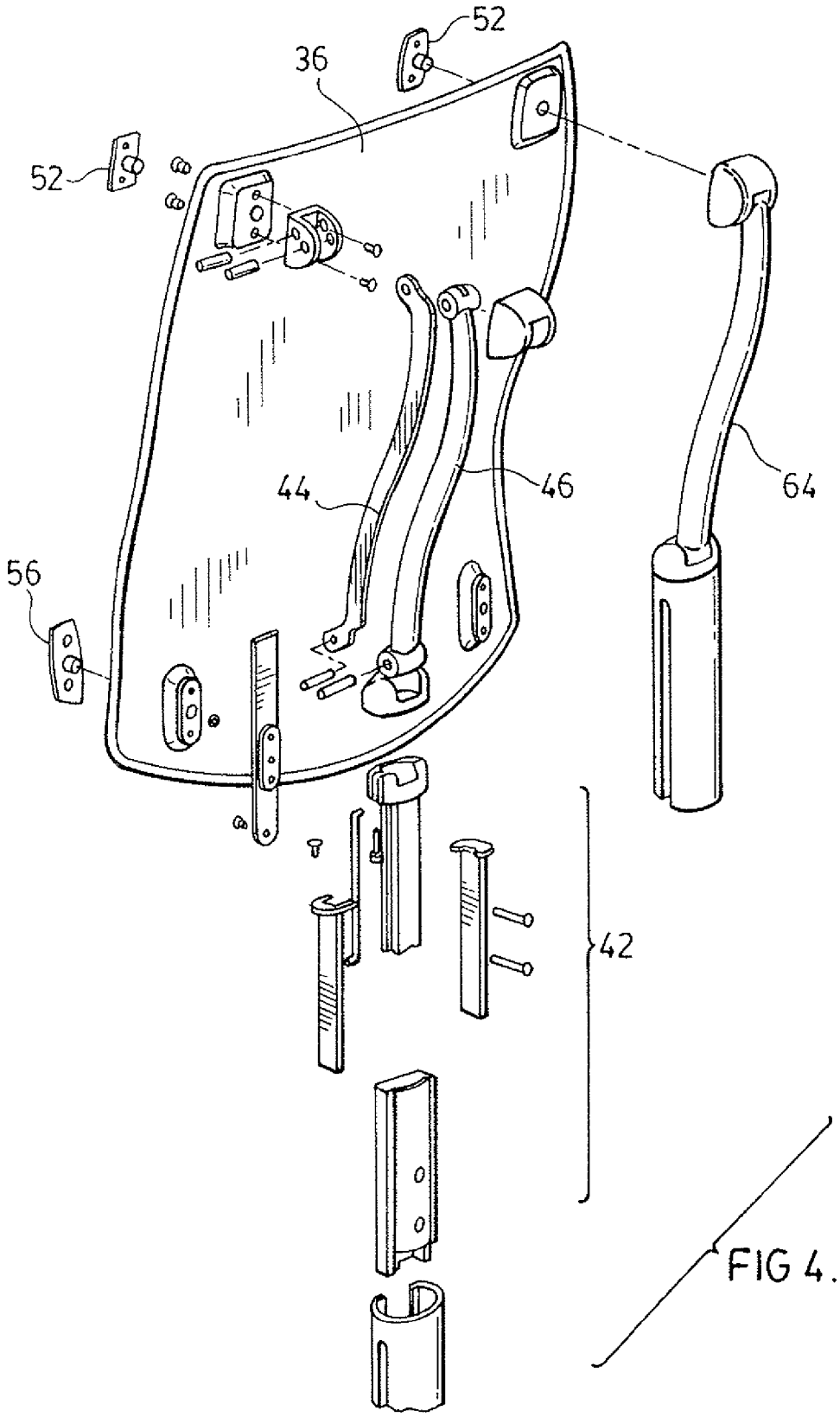
FIG. 4 is an exploded perspective view illustrating the struts at the rear of the backrest; and, FIG. 5 is a perspective view illustrating a parallelogram linkage comprising one of the struts.

FIG. 4 shows in detail the components of the struts and arm structures in exploded positions. It will be seen that these components include a shroud 64 which, in the assembled chair (see FIG. 1) covers and encloses the links 44, 46, the upper fitting 48 and arm upper portion 42. The shroud is appropriately finished to provide a decorative appearance.

Reverting to FIG. 2, it will be seen that the parallelogram linkage provided by the two links 44 and 46 and the respective pivot points for those links are configured so that, when a person seated on a chair leans back and applies pressure to the backrest generally in the region of the thorax area 34*b*, the links 44, 46 move with respect to one another to change the profile of the backrest so that the contour of the lumbar region 34*a* increases in curvature while the upper portion of the backrest in the thorax region 34*b* remains flat and moves rearwardly while remaining generally parallel to its normal rest position, instead of simply inching rearwardly as it otherwise would. This supports the upper thorax, shoulder and neck regions of the person against strains that would otherwise occur as the person attempts to, for example, continue looking at a computer screen while leaning back in the chair.

Applicant does not intend to be bound by theory. At the same time, it is believed that the invention is based on medically sound principles of emphasing kyphosis in the thorax area of the person to compensate for lordosis in the lumbar area. Lordosis is defined as forward curvature of the spine and kyphosis is rearward curvature, both following the slightly S-shaped curvature of a healthy spine. In a healthy spine, the portion above about the sixth thorax vertebra tends to tilt forward. This tilt is accentuated or supported by the backrest contour that is achieved in accordance with the present invention.

The precise changes in contour that occur of course depend on the relative lengths of the two links 44, 46 and on the relative positions of their pivot points. For example, in the illustrated embodiment, shortening the inner link would have the effect of tending to cause some forward curvature of thorax region 34*b* of the backrest, tending to increase support in that area.

It will of course be appreciated that the preceding description relates to a particular preferred embodiment of the invention and that a number of modifications are possible, some of which have been indicated previously, while others will be apparent to a person skilled in the art. Obviously, the particular design and configuration of the parallelogram links may change. The manner in which the struts are coupled to the seat of the chair may also change. In the illustrated embodiment, each strut 30 is coupled to the seat support structure 24*a* of the chair seat by an arm 32 that extends forwardly from the lower end of the strut. The strut itself is then coupled to upper and lower regions of the seat back as shown in FIGS. 2 and 3. However, this arrangement may vary. As a minimum, the lower end of the strut should be coupled to the seat, either directly, for example, as shown, or via the lower region of the seat back where the back is coupled relatively rigidly to the seat. It is of course important that the lower end of the strut be held firmly with respect to the seat to provide a fixed point against which a person on the seat can push in leaning back.

The invention claimed is:

1. A chair comprising a base, a seat supported on the base and a back coupled to at least one of the seat and base, wherein the back comprises a backrest having a normal curved contour as seen from the side including a lower, lumbar region for contact by the lumbar area of a person seated on the chair and which is forwardly curved, and an upper region for contact by the upper thorax of the person, the backrest being biased to said normal contour and flexible to vary said contour, and the back further comprising at least one upright strut spanning the lumbar and upper thorax regions of the backrest, the strut having a lower end which is fixed with respect to the seat and an upper end which is coupled to said upper region of the backrest for back and forward movement therewith in response to rearward pressure exerted by said person leaning back against the backrest and return to said normal contour, the strut comprising a parallelogram linkage operative to increase the curvature of said lumber region while at least substantially maintaining the contour of said upper region of the backrest in response to said rearward pressure.

2. A chair as claimed in claim 1, comprising a pair of struts at respectively opposite sides of the back and each coupled both to said upper region of the backrest and to the backrest at a lower region below said lumbar region.

3. A chair as claimed in claim 2, wherein each said strut is coupled to the base of the chair by an arm that extends forward from a bottom end of said strut.

4. A chair as claimed in claim 1, wherein said parallelogram linkage comprises an inner link and an outer link disposed respectively closer to and further away from said backrest, wherein the outer link is wider than the inner link and includes a slot receiving the inner link for permitting the links to nest together.

5. A chair as claimed in claim 1, wherein said parallelogram linkage is disposed externally with respect to the backrest and is enclosed within a decorative shroud.

6. A chair as claimed in claim 1, wherein said backrest comprises a plastic moulding having an as-moulded shape that represents said normal curved contour of the backrest, and wherein the plastic moulding is resiliently deflectable to permit said contour variation, the moulding inherently providing said biasing to said normal contour.

7. A chair as claimed in claim 6, wherein said moulding comprises a solid back wall which carries a resilient cushion structure for contact with the back of a person using the chair.

* * * * *